United States Patent [19]

Hendrickson, Sr. et al.

[11] 3,994,756

[45] Nov. 30, 1976

[54] CASTABLE COMPOSITE EXPLOSIVE COMPOSITIONS CONTAINING A MIXTURE OF TRINITROBENZENE AND TRINITROXYLENE

[75] Inventors: John R. Hendrickson, Sr., Dover, N.J.; Franklin B. Wells, Memphis, Tenn.

[73] Assignee: The United States of America as represented by the Secretary of the Army, Washington, D.C.

[22] Filed: Nov. 26, 1975

[21] Appl. No.: 635,480

[52] U.S. Cl. ..... 149/18; 149/92; 149/105; 149/106

[51] Int. Cl.[2] ..... C06B 45/06; C06B 25/34; C06B 25/06

[58] Field of Search ..... 149/18, 92, 106, 105

[56] References Cited

UNITED STATES PATENTS

| | | | |
|---|---|---|---|
| 3,271,212 | 9/1966 | Riedl et al. | 149/92 |
| 3,379,585 | 4/1968 | Miller et al. | 149/18 |
| 3,466,205 | 9/1969 | Boilean et al. | 149/18 |
| 3,515,604 | 6/1970 | Hamrick | 149/105 X |
| 3,620,857 | 11/1971 | Soderberg et al. | 149/18 |

OTHER PUBLICATIONS

Efremov et al., *Chem. Abs.*, 23, 2349 (1929).

Burkardt I, *Chem. Abs.*, 51, abs. No. 11,832(*a*) (1957).

Burkardt II, *Chem. Abs.*, 57, abs. No. 10,578(*a*) (1962).

*Primary Examiner*—Edward A. Miller

*Attorney, Agent, or Firm*—Nathan Edelberg; A. Victor Erkkila

[57] ABSTRACT

Castable composite explosive compositions contain a fusible matrix of about 80 to 95% by weight of trinitrobenzene and about 5 to 20% by weight of trinitroxylene and a particulate explosive melting substantially higher than said mixture.

3 Claims, No Drawings

CASTABLE COMPOSITE EXPLOSIVE COMPOSITIONS CONTAINING A MIXTURE OF TRINITROBENZENE AND TRINITROXYLENE

GOVERNMENTAL INTEREST

The invention described herein may be manufactured, used and licensed by or for the Government for Governmental purposes without the payment to me of any royalties thereon.

BACKGROUND OF THE INVENTION

Castable composite (e.g. binary and ternary) explosive compositions containing TNT (2,4,6-trinitrotoluene) as a fusible matrix constitute an important class of military explosives. Examples of such composite explosive include Composition B (60% RDX — cyclotrimethylenetrinitramine and 40% TNT — 2,4,6-trinitroluene plus 1% wax added), Cyclotols (RDX and TNT in weight ratios of 75/25, 70/30, 65/35, and 60/40 resp.), Amatol ($NH_4NO_3$ and TNT), Amatex ($NH_4NO_3$, RDX and TNT), Kalatol ($KNO_3$ and TNT), Baratol ($Ba(NO_3)_2$ and TNT), Pentolite (PETN-pentaerythritol tetranitrate and TNT) and Baronal ($Ba(NO_3)_2$, aluminum and TNT). Such compositions are generally prepared in cast form by stirring the powdered solid components, which include such materials as RDX, HMX (cyclotetramethylenetetranitramine), PETN, $NH_4NO_3$, $KNO_3$, $Ba(NO_3)_2$, $Pb(NO_3)_2$, $KClO_4$, and $NH_4ClO_4$ and mixtures thereof which are essentially insoluble in and have a substantially higher melting point than TNT, with the molten TNT until a homogeneous dispersion or slurry is obtained. The molten slurry is then loaded into shells or other ordnance items by pouring into the cavity and allowing the melt to cool and solidify. However, in view of its low melting point of about 81° C, TNT cannot withstand the high temperature encountered through aerodynamic heating of supersonic rocket warheads and other advanced ordnance items, which cause melting of the solid explosive charge with attendant adverse effect on ballistic properties. In addition, TNT suffers from exudation of an oily liquid under normal storage conditions.

Consequently, a need exists for a substitute for TNT as a fusible matrix, which is capable of better withstanding the high temperatures such as those encountered through aerodynamic heating of rocket warheads and possesses at least the explosive power of TNT.

Sym. trinitrobenzene (TNB) appeared to be an ideal replacement for TNT as a fusible matrix in view of its higher melting point of 122°–123° C, higher density, higher detonation velocity and lack of exudation of oils. However, TNB is unsuitable for the purpose, since safety regulations at Picatinny Arsenal prohibit the use of heating media at higher temperatures than that of steam at 15 psi gauge (so called 15 lb steam), corresponding to 121° C, which is too low for use with TNB based compositions.

In an attempt to overcome the aforesaid temperature disadvantage it was proposed to use a mixture of TNB with a minor proportion of another nitro compound which would have essentially the explosive characteristics of TNB and would melt at a temperature well above that of TNT but low enough to permit processing with 15 lb. steam. Mixtures of TNB and TNT were first considered, using proportions to take advantage of the favorable properties of a eutectic mixture. However, it was found that the TNB/TNT mixtures melted at excessively low temperatures and presented the possibility of exudation of oils due to the content of TNT.

SUMMARY OF THE INVENTION

A principal object of the invention is to prepare castable composite explosive compositions containing a novel fusible matrix, which possesses at least the explosive power of TNT, can be melted at the temperature of 15 lb. steam, has ability to withstand high temperatures such as those encountered through aerodynamic heating of rocket warheads, etc. and is devoid of exudation of oil under normal storage conditions.

Another object is to provide castable high explosive compositions containing the novel fusible matrix and particulate cyclotrimethylenetrinitramine (RDX) and/or cyclotetramethylenetetranitramine (HMX).

Other objects will become apparent as the invention is further described hereinafter.

In accordance with the present invention, the foregoing objects are attained by novel castable composite explosive compositions, which consist essentially of a. a mixture of from 80 to 95 weight percent of sym. trinitrobenzene (TNB) and from 5 to 20 weight percent of sym. trinitro-m-xylene (TNX), and b. a particulate explosive material melting substantially higher than said mixture of TNB and TNX.

Such mixtures of TNB and TNX melt at temperatures well above the melting point of TNT and yet low enough to be fusible at the temperature of 15 lb. steam; and they possess to a high degree the advantageous properties of the eutectic mixture of TNB and TNX, which melts at about 117° C and contains approximately 7 parts by weight of TNB and 1 part by weight of TNX.

Preferred castable explosive compositions of the present invention consist essentially of a. about from 50 to 80 weight percent of particulate RDX or HMX and mixtures thereof, and b. about from 20 to 50 weight percent of a mixture of from 80 to 95 weight percent of TNB and from 5 to 20 weight percent of TNX.

In the course of studies of TNB as a substitute matrix for TNT, it was found that compositions consisting of 70 weight percent of RDX or HMX and 30 weight percent of TNB, which had been considered as primary goals for the replacement of 70/30 cyclotol and 70/30 octol, resp., do not pass the Picatinny Arsenal friction sensitivity test. This test is one of several required for qualifying military explosives and is described in Picatinny Arsenal Testing Manual 7-1, "Friction Pendulum", by J. H. McIvor, dated 8 May 1950. According to this test the material must show no reaction, i.e. crackles, fire or explosion, in twenty consecutive tests with a steel shoe.

It has been unexpectedly found that composite explosive compositions, wherein the TNB matrix is replaced by the TNB/TNX matrix according to the present invention, meet the criteria of the aforesaid friction pendulum test. Also, the TNB/TNX matrix possesses an explosive power at least as great as TNT. A further advantage is that the crystals of such cast TNB/TNX mixtures are smaller than those of either of the separately solidified components. As a consequence denser castings with fewer defects are obtained by employing the TNB/TNX mixtures in place of TNT as the matrix in composite explosive compositions. The eutectic mixture is further advantageous in that it possesses a definite melting point and freezing point and thus behaves like a pure compound.

The following examples provide additional specific illustrations of castable composite explosive compositions of the invention. In the examples, the percentages reported are by weight.

Example 1

| | |
|---|---|
| A eutectic mixture of | |
| TNB (Sym. trinitrobenzene, m.p. 122° C.) | 87.5% |
| TNX (2,4,6-trinitro-m-xylene, m.p. 182° C.) | 12.5% |

was heated in an electrically heated vessel to 118°–120° C until all solids were melted. The melt was then allowed to cool to a solid, which was broken up and subjected to several tests with the following results:

| | |
|---|---|
| Five second decomposition temperature[1] | 365.2° C. |
| Friction pendulum sensitivity test (w/steel shoe)[2] | no reaction |
| Electrostatic sensitivity (unconfined)[1] | 0.5 joule |
| Melting point[3] | 117° C. |
| PA Impact Sensitivity[1] (with 2 Kg hammer and 13 mg. charge) | 10 inches |
| Vacuum stability[1] (5 g/48 hours) | |
| gas evolved at 100° C. | 0.11 ml |
| gas evolved at 130° C. | 0.28 ml |

[1]Described in Picatinny Arsenal Technical Report (PATR) 3278, Rev. 1, "Standard Laboratory Procedures for Determining Sensitivity, Brisance and Stability of Explosives", by A. J. Clear, dated April 1970.
[2]Picatinny Arsenal Testing Manual 7-1, "Friction Pendulum", by J. H. McIvor, dated 8 May 1950.
[3]40 mesh material used at heating rate of 0.5–1.0° C/min. Melting point was determined with a Hoover Capillary Melting Point Apparatus described in A. H. Thomas' "Scientific Apparatus and Reagents", No. 74 p. 840 (1974).

Example 2

| | |
|---|---|
| A composite explosive of the following composition | |
| HMX[1] | 70.00% |
| TNB | 26.25% |
| TNX | 3.75% |

[1]Grade I HMX (28.0/13/9/58.1 Class A/Class C/Class D blend) which meets the requirements of Specification MIL-H-45444A (Ord) with Amendment 3 dated 31 July 1972.

was prepared by melting the TNB and TNX together and adding the HMX in small increments to the molten mixture with agitation while maintaining the melt temperature at 118°–120° C or above. When the addition of HMX was complete the mixture was subjected to a vacuum for about 15 minutes and then allowed to cool and solidify.

The casting thus obtained was subjected to several tests with the following results:

| | |
|---|---|
| Five second decomposition temperature | 318.6° C |
| Friction pendulum sensitivity test (with steel shoe) | no reaction |
| Electrostatic sensitivity (unconfined) | 9.76 joules |
| PA Impact Sensitivity (with 2 Kg hammer + 13 mg charge) | 10 inches |
| Vacuum thermal stability (5g/48 hrs) | |
| gas evolved at 100° C | 0.11 ml |
| gas evolved at 130° C | 0.61 ml |

Example 3

| | |
|---|---|
| The following explosive composition | |
| RDX[1] | 70.00% |
| TNB | 26.25% |

Example 3-continued

| | |
|---|---|
| TNX | 3.75% |

[1]Type B RDX (a 15/63/22 Class A/Class D/Class G blend) which meets the requirements of Specification MIL-R-398C dated 22 August 1962.

was prepared in the same manner as the composition of example 2 and tested with the following results:

| | |
|---|---|
| Five second decomposition temperature | 282.5° C |
| Friction pendulum sensitivity test (with steel shoe) | no reaction |
| Electrostatic sensitivity (unconfined) | 3.475 joules |
| PA impact sensitivity with 2 Kg hammer + 13 mg charge) | 17 inches |
| Vacuum thermal stability (5g/48 hours) | |
| gas evolved at 100° C | 0.29 ml |
| gas evolved at 130° C | 2.34 ml |

The compositions of the foregoing examples have thus passed the foregoing partial list of mandatory requirements for qualification as military explosives.

Example 4

| | |
|---|---|
| A 4000 gram lot of the following explosive composition | |
| RDX | 60% |
| TNB | 32% |
| TNX | 8% |

was prepared in the manner described in example 2 except that the preparation was carried out in a 3 gallon jacketed kettle heated with 15 lb steam (15 psi gauge).

The 32/8 TNB/TNX mixture employed as the matrix in the composition has a melting range of 113° – 119.8° C with most of the solids in solution at about 116° C. Despite this relatively wide melting range, the composition of this example, which is an analogue of 60/40 cyclotol, was found to behave exactly like a low viscosity 60/40 cyclotol (consisting of 60% RDX and 40% TNT) in the de-aeration and pouring stages in melt-loading operations.

A casting prepared from the composition of this example had a density of 1.747 g/ml, which is 99.4% of the TMD. It produced no exudate when stored at 82° C for a period of 119 days. In a fragment velocity test[1] the composition of this example imparted initial velocities to fragments of about 6042 feet/second, which is about 300 feet/second greater than the initial velocity imparted under the same conditions by composition B, a standard explosive composition, which is essentially a 60/40 cyclotol containing about 1% wax. In addition, the composition of this example met the requirements of the following qualification tests for military explosives with the following test results:

| | |
|---|---|
| Impact sensitivity (2 Kg hammer + 13 mg charge) | 18 inches |
| Vacuum stability (5 g.) | |
| gas evolved at 120° C/40 hours | 0.70 ml |
| gas evolved at 130° C/40 hours | 1.93 ml |
| gas evolved at 140° C/40 hours | 11 + *ml |
| gas evolved at 140° C/8 hours | 1.78 ml |

*11 ml is the maximum reading of the test apparatus.
[1]PATR 4587 "The Sensitivity, Performance and Material Properties of Some High Explosive Formulations", p. 3, by T. S. Costain and R. V. Motto, dated September 1973.

In analogous manner other castable composite explosive compositions possessing similar advantageous properties can be prepared by employing the TNB/TNX mixtures as a novel matrix for other particulate explosives melting substantially higher than said matrix as noted above, e.g. ammonium nitrate and pentaerythritol tetranitrate.

The foregoing disclosure and drawings are merely illustrative of the principles of this invention and are not to be interpreted in a limiting sense. We wish it to be understood that we do not desire to be limited to the exact details of construction shown and described, because obvious modifications will occur to a person skilled in the art.

What is claimed is:

1. A castable composite explosive composition consisting essentially of a. a mixture of from 80 to 95 weight percent of sym-trinitrobenzene from 5 to 20 weight percent of sym-trinitro-m-xylene, and b. a particulate explosive melting substantially higher than said mixture of trinitrobenzene and trinitroxylene.

2. A castable composite explosive composition consisting essentially of a. about from 50 to 80 weight percent of particulate cyclotrimethylenetrinitramine or cyclotetramethylenetetranitramine and mixtures thereof, and b. about from 20 to 50 weight percent of a mixture of from 80 to 95 weight percent of sym-trinitrobenzene and from 5 to 20 weight percent of sym-trinitro-m-xylene.

3. A castable composition according to claim 2, wherein the mixture of trinitrobenzene and trinitroxylene is a eutectic mixture, containing about 7 parts by weight of trinitrobenzene and about 1 part by weight of trinitroxylene.

* * * * *